US012631012B2

(12) United States Patent
Wang et al.

(10) Patent No.: US 12,631,012 B2
(45) Date of Patent: May 19, 2026

(54) SENSOR ASSEMBLY FOR FAUCET

(71) Applicant: Hsiang-Hung Wang, Changhua County (TW)

(72) Inventors: Hsiang-Hung Wang, Changhua County (TW); Yu-Chang Lin, Changhua County (TW)

(73) Assignee: Hsiang-Hung Wang, Changhua County (TW)

( * ) Notice: Subject to any disclaimer, the term of this patent is extended or adjusted under 35 U.S.C. 154(b) by 115 days.

(21) Appl. No.: 18/772,264

(22) Filed: Jul. 15, 2024

(65) Prior Publication Data

US 2026/0015841 A1 Jan. 15, 2026

(51) Int. Cl.
*E03C 1/05* (2006.01)
*E03C 1/04* (2006.01)

(52) U.S. Cl.
CPC ..... *E03C 1/057* (2013.01); *E03C 1/0404* (2013.01)

(58) Field of Classification Search
CPC ..... E03C 1/057; E03C 1/0404
USPC ..... 4/668, 671, 675, 541.2, 378, 679, 623; 137/386; 236/12.1
See application file for complete search history.

(56) References Cited

U.S. PATENT DOCUMENTS 6,082,407 A * 7/2000 Paterson ..... E03C 1/057 137/801
6,294,786 B1 * 9/2001 Marcichow ..... E03C 1/05 250/341.1

FOREIGN PATENT DOCUMENTS

JP 2020159165 A * 10/2020 ..... E03C 1/057
JP 2022186446 A * 12/2022 ..... E03C 1/057
JP 2025008419 A * 1/2025 ..... E03C 1/057
WO WO-2006076149 A1 * 7/2006 ..... E03C 1/0401

* cited by examiner

*Primary Examiner* — Lori L Baker
(74) *Attorney, Agent, or Firm* — Leong C. Lei

(57) ABSTRACT

The sensor assembly is applied to a faucet, where the faucet has a vertical section and an inclined outlet section connected to a top end of the vertical section, and a water outlet is configured on a bottom side of a front end of the inclined outlet section. The sensor assembly includes a sensor unit and a sensor cover. The sensor unit is embedded in an indentation provided on the inclined outlet section adjacent to the water outlet. The indentation is sealed by the sensor cover. The sensor unit includes an upper attachment element. The sensor cover includes a corresponding lower attachment element. The sensor cover is joined to the sensor unit, thereby sealing the indentation, with the attachment between the upper and lower attachment elements. The sensor assembly is easy to assemble and the maintenance is convenient as the sensor cover can be easily detached.

4 Claims, 4 Drawing Sheets

SENSOR ASSEMBLY FOR FAUCET

BACKGROUND OF THE INVENTION

(a) Technical Field of the Invention

The present invention generally relates to electronic faucets, and more particularly to a sensor assembly for an electronic faucet.

(b) Description of the Prior Art

The conventional sensor in electronic faucets involves attaching a cover to the sensor's exterior and sealing the cover's periphery with waterproof adhesive. When repairing the sensor of a conventional electronic faucet, the waterproof adhesive needs to be removed, and tools must be used to pry off the cover before proceeding with the maintenance. After the repair, the cover must be reattached to the electronic faucet, and waterproof adhesive must be reapplied.

The drawbacks of the above-described structure are:

1. The need to apply and remove waterproof adhesive for each maintenance session is cumbersome and inconvenient.
2. The use of tools can easily damage or puncture the cover.

Addressing these issues in conventional structures is a challenge that industry professionals are actively seeking to solve.

SUMMARY OF THE INVENTION

The present invention provides an improved assembly structure for the sensor of a faucet. The primary objective is to use a magnetic attachment structure to secure the sensor cover, making the assembly process easy and time-saving.

The present invention also aims to improve the assembly structure by having a screw at one end of the sensor cover. Inside the sensor cover, there is an anti-loosening element. By turning the screw, the anti-loosening element gradually detaches the cover from the faucet, preventing scratches or damage to both the faucet and the cover.

A sensor assembly according to the present invention is applied to a faucet, where the faucet has a vertical section and an inclined outlet section, whose back end is connected to a top end of the vertical section, and a water outlet is configured on a bottom side of the front end of the inclined outlet section. The sensor assembly includes a sensor unit and a curved sensor cover. The sensor unit is embedded in an indentation provided on the bottom side of the front end of the inclined outlet section adjacent to the water outlet. The indentation is sealed by the sensor cover. The sensor unit includes an upper attachment element positioned at a predetermined location. The sensor cover includes a corresponding lower attachment element. The sensor cover is joined to the sensor unit, thereby sealing the indentation, with the attachment between the upper and lower attachment elements.

Specifically, the sensor cover is a curved case having an assembly hole and an anti-loosening element inside the assembly hole. A screw engages the anti-loosening element inside the assembly hole. The screw is threaded into the anti-loosening element, and an outer edge of the assembly hole forms a cylinder. By turning the screw, the anti-loosening element is pressed downward, causing the sensor cover to separate from the sensor unit.

Specifically, the upper and lower attachment elements are magnets with opposite poles.

Through the above description, the features and benefits of the present invention are summarized as follows:

1. In the present invention, there is no need to apply waterproof adhesive around the sensor cover, thus achieving ease of assembly and maintenance.
2. In the present invention, the sensor cover is attached using magnetic elements, making the assembly process quick and convenient.
3. For maintenance, the present invention requires only the turning of a screw to detach the sensor cover, eliminating the need for sharp tools that could scratch or damage the sensor cover or the faucet.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
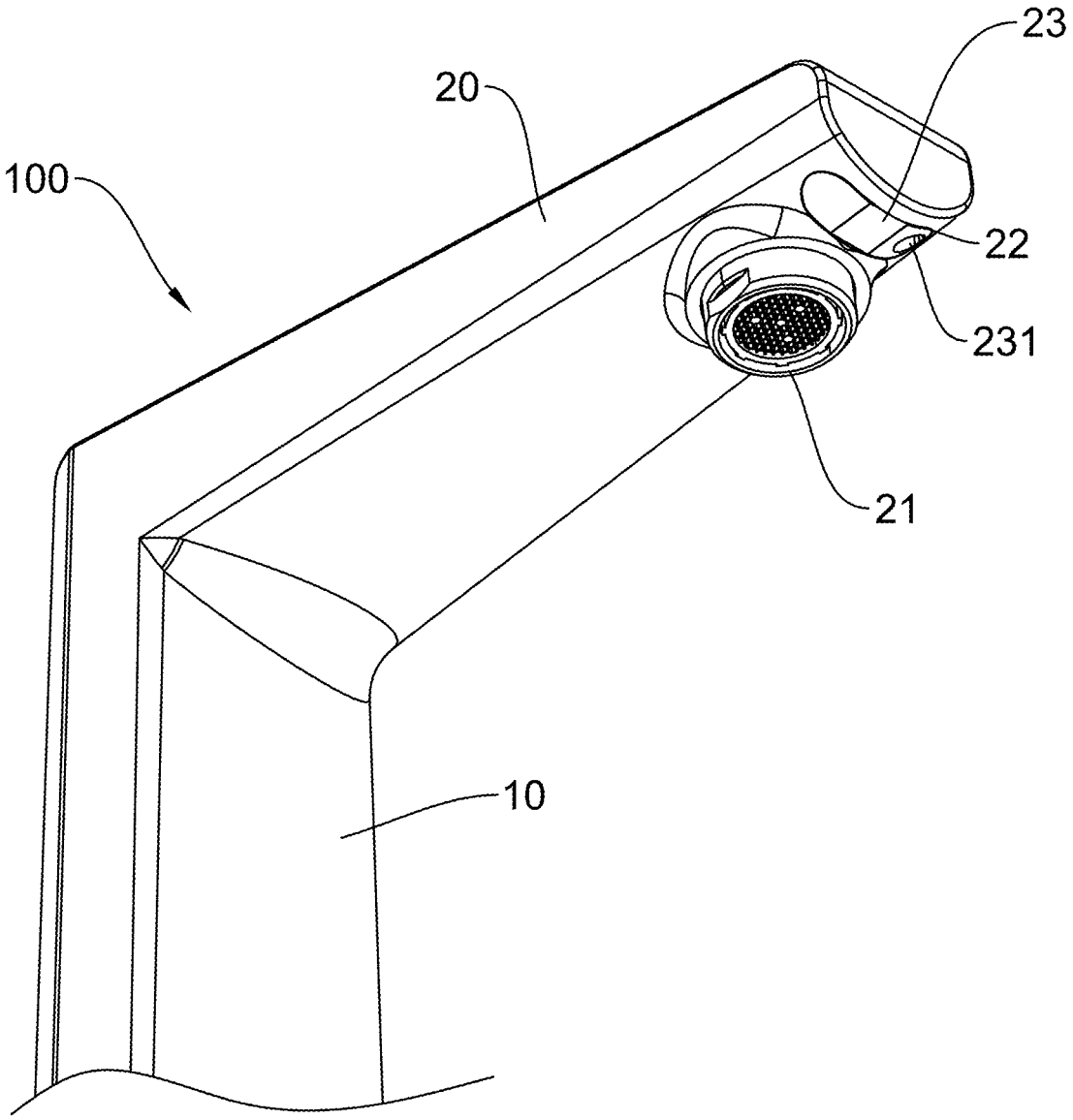
FIG. 1 is perspective diagram showing a sensor assembly according to an embodiment of the present invention applied to a faucet.
Figure 2:
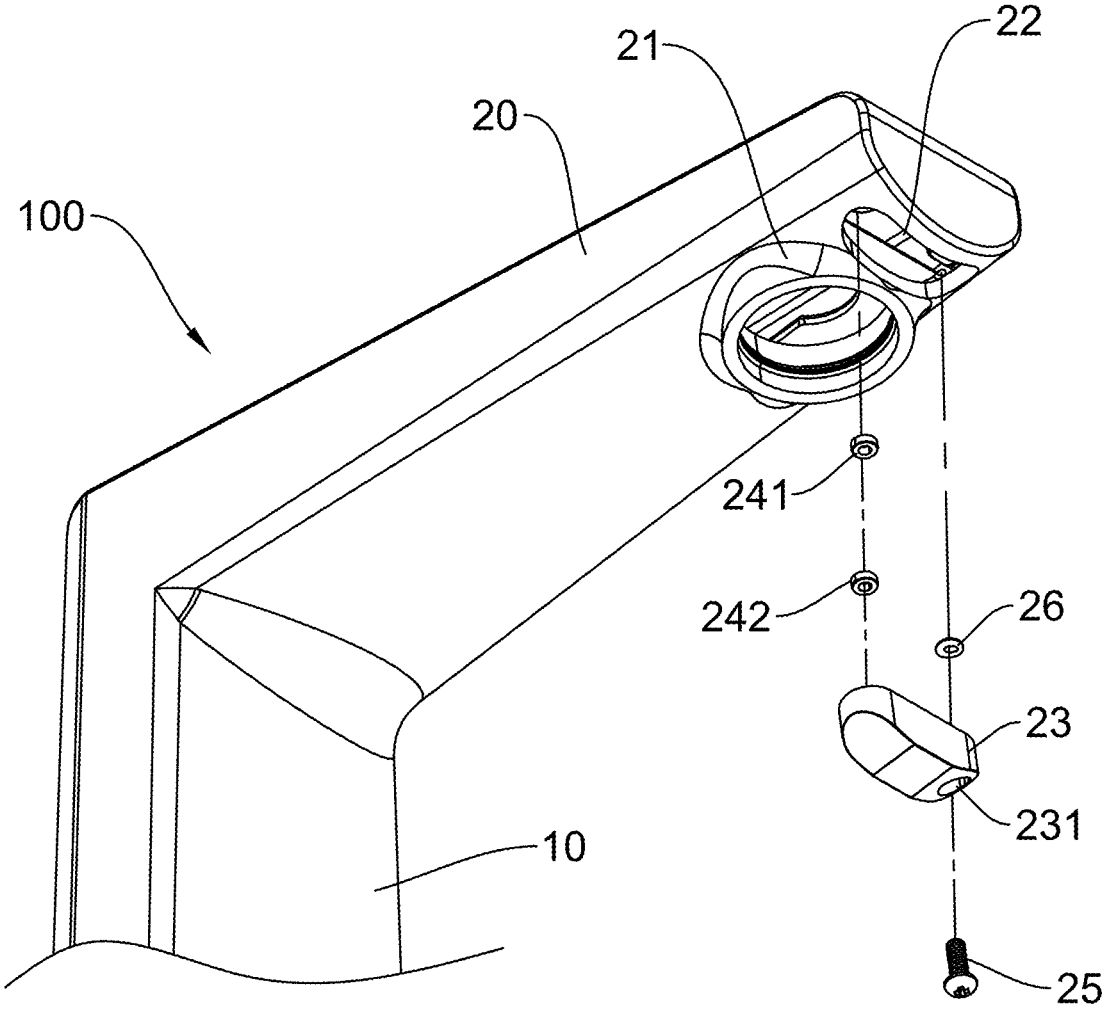
FIG. 2 is a perspective break-down diagram showing the sensor assembly of FIG. 1.
Figure 3:
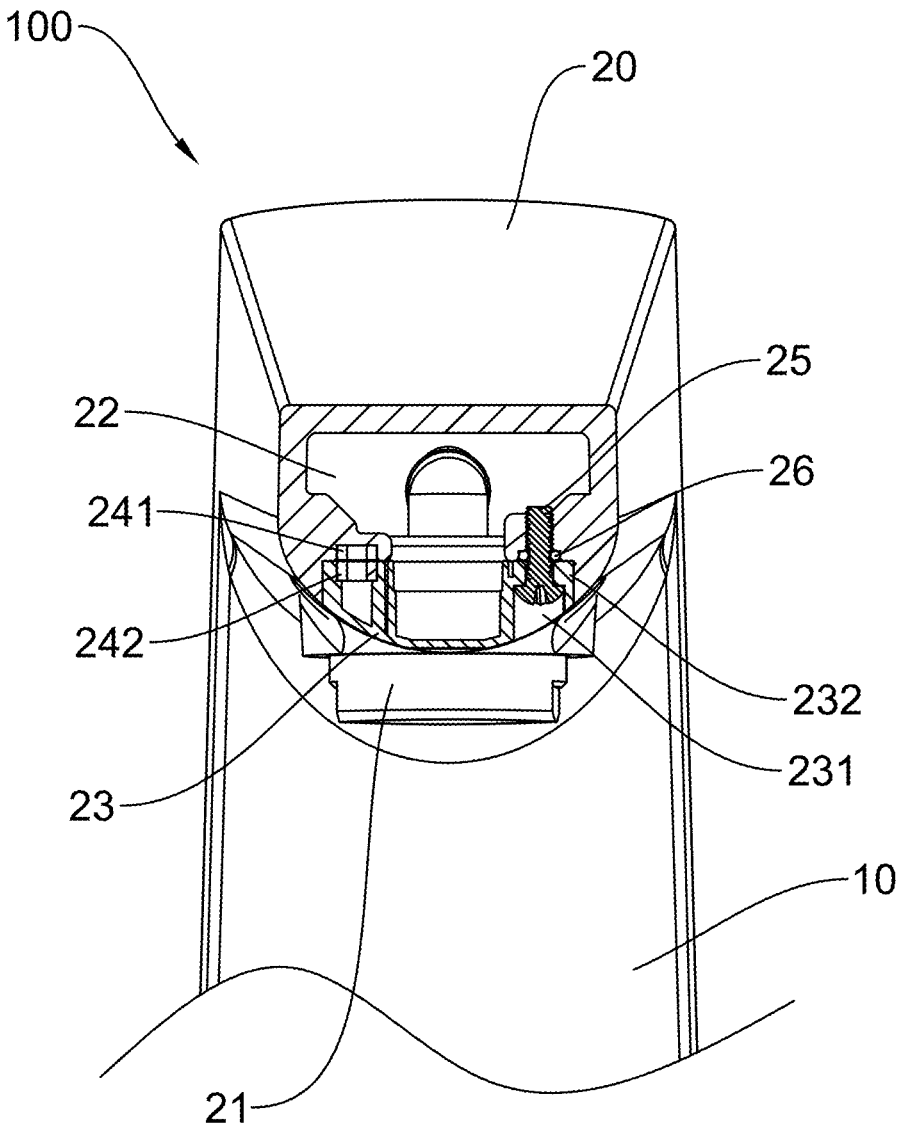
FIG. 3 is a sectional diagram showing the sensor assembly of FIG. 1.

As shown in FIGS. 1 to 3, the sensor assembly according to an embodiment of the present invention is applied to a faucet 100 having a vertical section 10 and an inclined outlet section 20, whose back end is connected to a top end of the vertical section 10. A water outlet 21 is configured on a bottom side of the front end of the inclined outlet section 20.

As illustrated, a sensor unit 22 is embedded in an indentation (not numbered) provided on the bottom side of the front end of the inclined outlet section 20 adjacent to the water outlet 21. The indentation is sealed by a curved sensor cover 23. The sensor unit 22 includes an upper attachment element 241 positioned at a pre-determined location. The sensor cover 23 includes a corresponding lower attachment element 242. With the attachment between the upper and lower attachment elements 241 and 242, the sensor cover 23 is joined to the sensor unit 22, thereby sealing the indentation.

In the present embodiment, the upper and lower attachment elements 241 and 242 are powerful magnets with opposite poles, which securely join the sensor cover 23 with the sensor unit 22.

Figure 4:
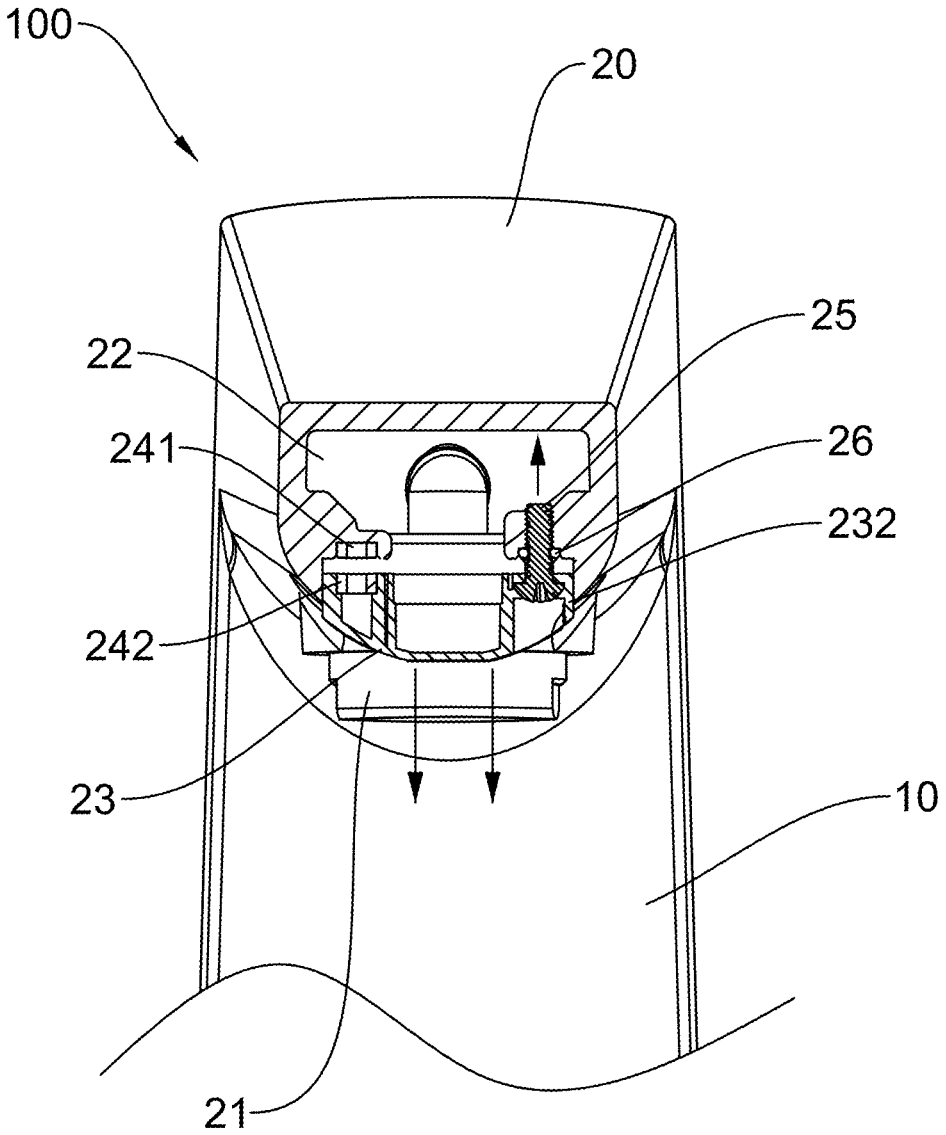
FIG. 4 is a sectional diagram showing a sensor cover of the sensor assembly of FIG. 1 being detached by turning a screw.

As shown in FIGS. 2 to 4, the sensor cover 23 is a curved case having an assembly hole 231 and an anti-loosening element 26 inside the assembly hole 231. Inside the assembly hole 231, a screw 25 engages the anti-loosening element 26, which can be can be a C-clip, an O-ring, or any device that prevents the screw 25 from loosening while being turned. The screw 25 is threaded into the anti-loosening element 26, and the outer edge of the assembly hole 231 forms a cylinder 232. By turning the screw 25, the anti-loosening element 26 is pressed downward, causing the sensor cover 23 to separate from the sensor unit 22. This detachment structure allows the sensor cover 23 to be separated from the sensor unit 22 without using sharp objects like a file.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A sensor assembly for a faucet, where the faucet has a vertical section and an inclined outlet section, whose back end is connected to a top end of the vertical section, and a water outlet is configured on a bottom side of the front end of the inclined outlet section, the sensor assembly characterized in that the sensor assembly comprises a sensor unit and a curved sensor cover;

the sensor unit is embedded in an indentation provided on the bottom side of the front end of the inclined outlet section adjacent to the water outlet;

the indentation is sealed by the sensor cover;

the sensor unit comprises an upper attachment element positioned at a pre-determined location;

the sensor cover comprises a corresponding lower attachment element;

the sensor cover is joined to the sensor unit, with an attachment between the upper and lower attachment elements.

2. The sensor assembly according to claim 1, wherein the sensor cover is a curved case having an assembly hole and an anti-loosening element inside the assembly hole; a screw engages the anti-loosening element inside the assembly hole; the screw is threaded into the anti-loosening element, and an outer edge of the assembly hole forms a cylinder; and, by turning the screw, the anti-loosening element is pressed downward, causing the sensor cover to separate from the sensor unit.

3. The sensor assembly according to claim 1, wherein the upper and lower attachment elements are magnets with opposite poles.

4. The sensor assembly according to claim 2, wherein the anti-loosening element is a C-clip or an O-ring.

* * * * *